United States Patent [19]

Chierici

[11] 4,006,692

[45] Feb. 8, 1977

[54] HOPPER CAR OUTLET GATE AND SEAL

[75] Inventor: Osvaldo F. Chierici, Elmhurst, Ill.

[73] Assignee: Holland Company, Lombard, Ill.

[22] Filed: May 2, 1975

[21] Appl. No.: 573,807

[52] U.S. Cl. ..... 105/282 P; 105/282 A; 105/308 R; 105/424

[51] Int. Cl.[2] ..... B61D 7/20; B61D 7/22; B61D 7/26; B61D 49/00

[58] Field of Search ..... 105/282 A, 282 P, 282 R, 105/299, 308 R, 424

[56] References Cited

UNITED STATES PATENTS

| | | | |
|---|---|---|---|
| 221,577 | 11/1879 | King | 105/282 R |
| 3,035,530 | 5/1962 | Meyers et al. | 105/308 R |
| 3,106,899 | 10/1963 | Dorey | 105/282 P X |
| 3,530,803 | 9/1970 | Adler | 105/282 P |
| 3,536,013 | 10/1970 | Nagy | 105/308 R X |
| 3,630,154 | 12/1971 | Mundinger | 105/308 R X |
| 3,635,170 | 1/1972 | Chierici | 105/299 X |
| 3,807,318 | 4/1974 | Chierici | 105/282 A |

*Primary Examiner*—Robert J. Spar
*Assistant Examiner*—Howard Beltran
*Attorney, Agent, or Firm*—McWilliams & Mann

[57] ABSTRACT

An outlet assembly for application to hoppers of railroad hopper cars and the like in the form of a frame made up of spaced pairs of longitudinal and transverse frame members joined together and shaped to define a continuation of the hopper car sheets, and slidably mounting a door plate or gate for movement between open and closed positions, in which the gate is a planar member of one piece molded construction formed from an ultra high molecular weight polymer and includes integral racks on either side of same that mesh with pinions journaled in the frame and reversably drivable, using conventional power equipment or the like, to move the gate between closed and opened positions. The gate assembly is equipped with a sanitary top seal that is in wiping engagement with the gate and is arranged to permit the lading when present to help provide the sealing action at the gate. The assembly also includes a positive gate stop to prevent accidental discharge of the gate from its trackway on being opened, and an automatic gate lock which operates to lock the gate in closed position when the gate is returned to closed position after having been opened.

6 Claims, 7 Drawing Figures

HOPPER CAR OUTLET GATE AND SEAL

OUTLET GATE AND SANITARY SEAL ARRANGEMENT FOR HOPPER CARS

This invention relates to outlet gates for railroad hopper cars and the like, and more particularly, to an outlet gate assembly adapted to provide the outlet for hoppers of hopper cars and the like and means to open and close same.

Conventional hopper car outlet gate arrangements are available in a number of forms, but all are generally arranged to define a continuation of the car hopper sheeting that narrows or funnels down to the outlet port itself, and to provide a door plate or gate that moves between open and closed positions to open and close the outlet of the hopper. The door plate itself in equipment of this type heretofore has ordinarily been formed from metal, usually steel. The door plate is therefore relatively heavy and as the trackway it rides on is also formed from steel, the power requirements to move the gate on a loaded hopper car from closed to open position are substantial.

Furthermore, some bulk materials such as potash tend to stick or adhere to the door plate, making it difficult to provide effective sealing about the door plate when the hopper is loaded. Effective sealing in this area is, of course, required to avoid loss of the bulk material during transit and contamination of the bulk material remaining in and around the door plate from admittance of foreign matter through interruptions in the seal about the gate.

A principal object of the present invention is to provide an outlet gate arrangement for railroad hopper cars in which the door gate or gate itself is formed from a light weight non-metallic material of self lubricating characteristics that also has surfacing characteristics which avoid the bulk material adherence problem.

Another important object of the invention is to provide a door plate and top seal arrangement for hopper car outlet gate assemblies that provides for effective uninterrupted sealing at and about the gate for bulk materials, such as potash.

Other objects of the invention are to provide a positive gate stop and automatic gate lock arrangement for hopper car outlet gate assemblies, and to provide a hopper car outlet gate assembly that is economical of manufacture, covenient to install and use, and long lived in operation.

In accordance with the present invention, a hopper car outlet gate assembly is provided in which the gate is of one piece molded construction and is formed from an ultra high molecular weight polymer, such as polyethylene with a molecular weight of at least 2 million being employed. The gate operating mechanism is of the rack and gear type, with the gate being formed on its underside with integral rack teeth, for cooperation with gearing journaled in the assembly that is arranged for reversible rotation to move the gate between its open and closed positions. The assembly includes a top seal about the hopper outlet opening which is in wiping engagement with the upper side of the gate for cleaning and sealing engagement therewith in an uninterrupted manner thereabout. The gate is of relatively light weight and has a coefficient of sliding friction on its trackway on the order of 0.02. The material from which the gate is formed resists adherence thereto of potash or the like, with the result that the gate moves smoothly and readily along its trackway, and the top seal has a wiping and sealing engagement with the upper side of the gate that is not disturbed by adherence to the gate of the bulk materials involved.

Also provided are an automatic gate lock arrangement that after setting for accommodating opening of the gate, operates automatically on return of the gate to closed position to hold the gate against opening, and a positive gate stop that precludes the gate from being shot out of its trackway by the pneumatic wrench devices that are frequently employed to operate gear and rack type outlet gate mechanisms.

Still other objects, uses and advantages will be obvious or become apparent from a consideration of the following detailed description and the application drawings.

However, it is to be distinctly understood that the specific drawing illustrations provided are supplied primary to comply with the requirements of the Patent Laws, and that the invention is susceptible of other embodiments which will be obvious to those skilled in the art and which are intended to be covered by the appended claims.

Figure 2:
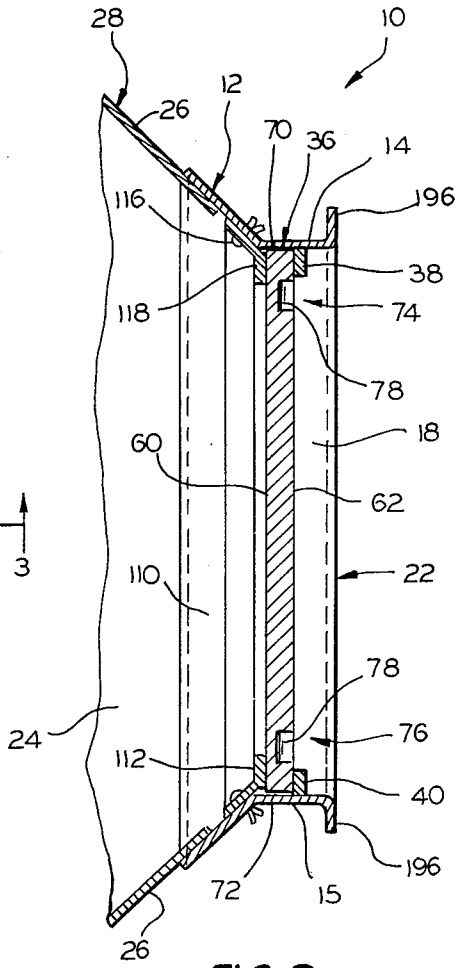
FIG. 2 is a cross-sectional view taken substantially along line 2—2 of FIGS. 1 and 3.
Figure 1:
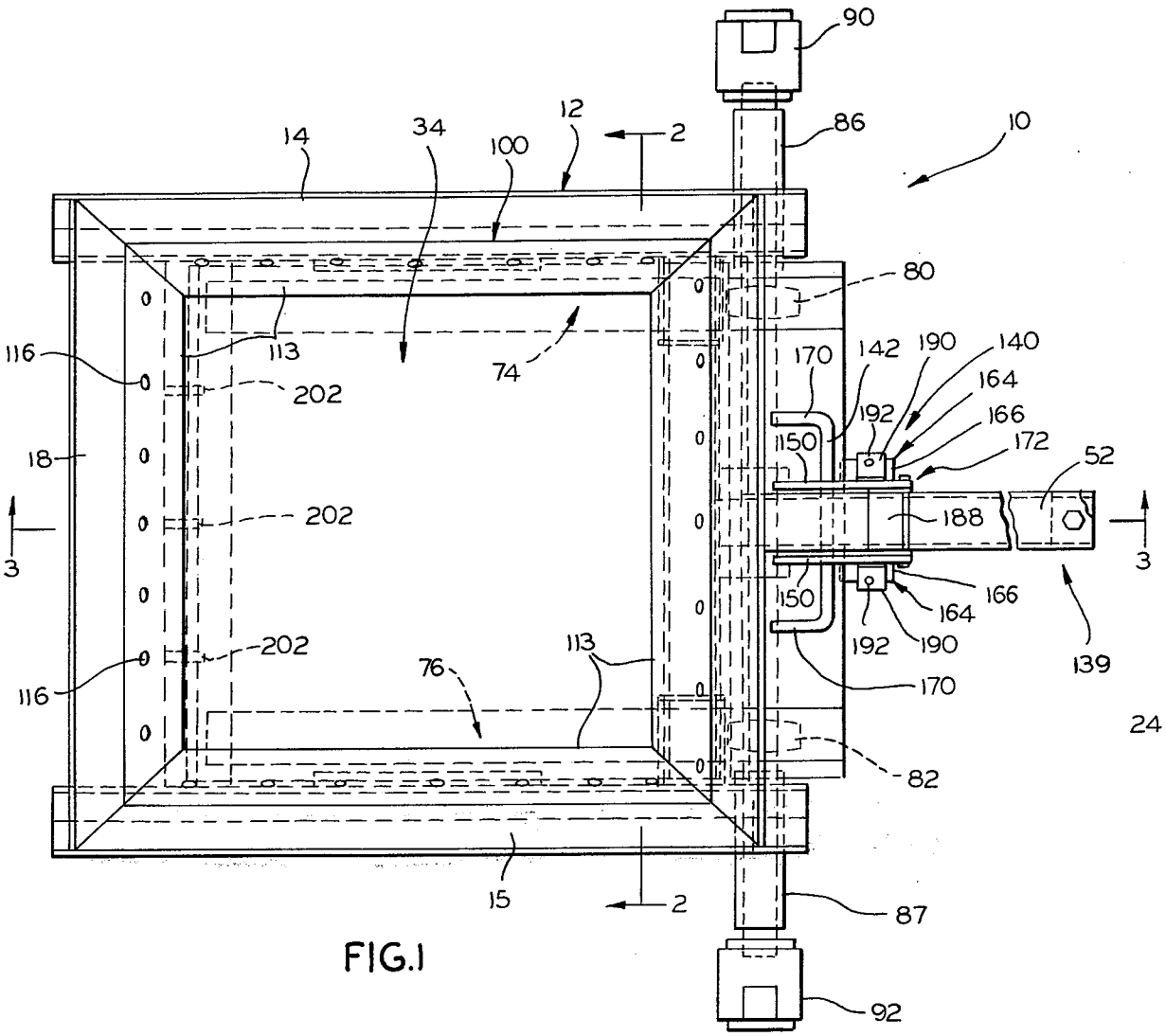
FIG. 1 is a top plan view of an outlet gate assembly arranged in accordance with the present invention.
Figures 3, 4, 5, 6, 7:
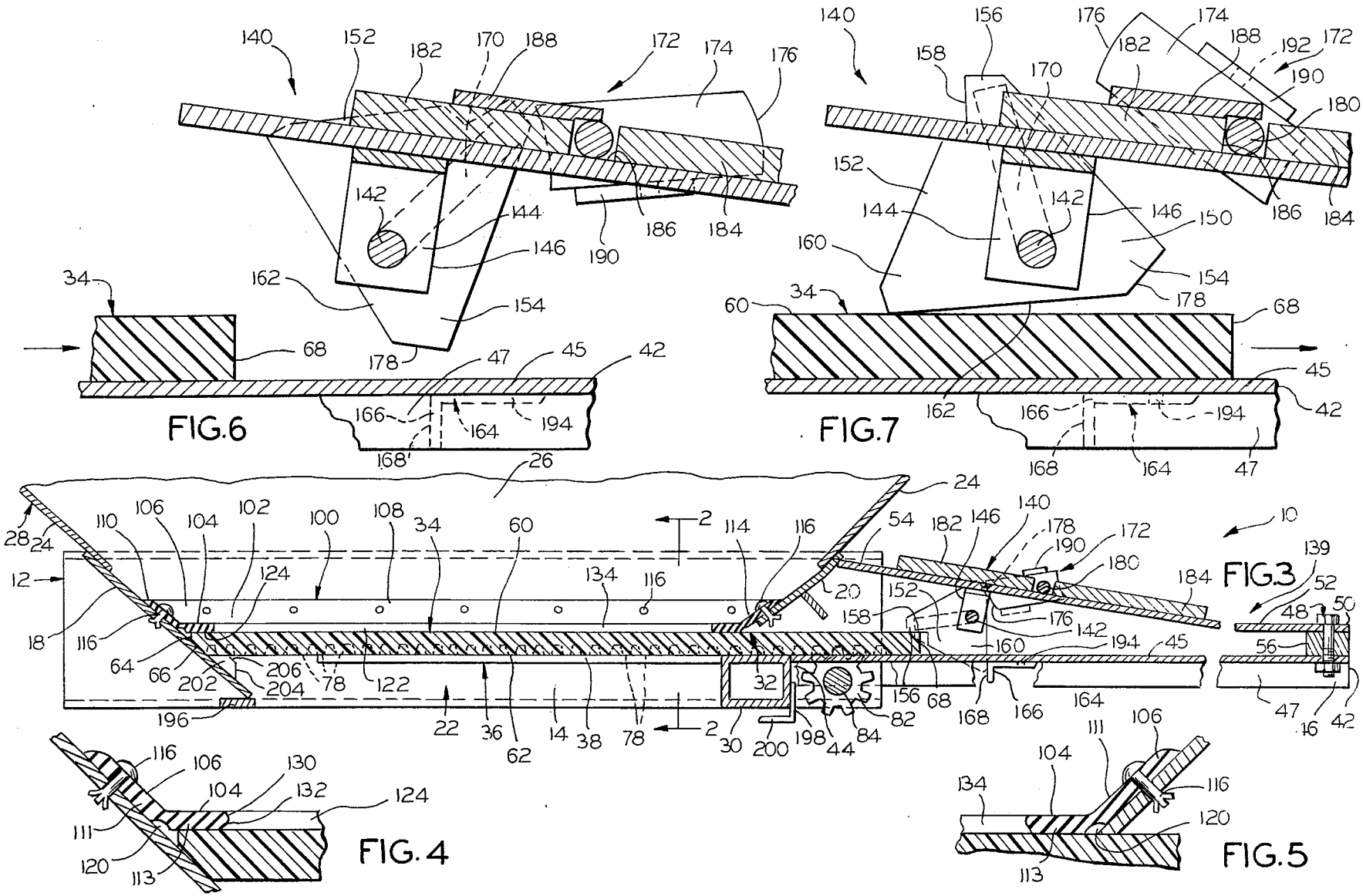
FIG. 3 is a cross-sectional view taken substantially along line 3—3 of FIG. 1.
FIGS. 4 and 5 are fragmental sectional views on an enlarged scale better illustrating the manner in which the top seal cooperates with the gate that is illustrated in FIG. 3.
FIG. 6 is a diagrammatic fragmental view on an enlarged scale illustrating the positioning of the gate locking pawls to permit opening of the gate.
FIG. 7 is a showing similar to that of FIG. 6, but showing the gate in the process of being moved to its open position and the effect of this movement on the gate locking pawls.

Reference numeral 10 of FIGS. 1–3 generally indicates a preferred embodiment of the invention which comprises a frame 12 formed by a pair of longitudinal frame members 14 and 15 joined together by a pair of transverse frame members 18 and 20 to define a hopper outlet opening or port 22. As indicated in FIGS. 1 and 2, the frame 12 is attached to the lower edges of the hopper car sheets 24 and 26 that define a railroad car hopper 28, (not shown in FIG. 1), the frame members 14, 15, 18 and 20 being formed to provide continuations of the respective hopper sheets 24 and 26 that converge in the direction of the outlet opening or port 22.

As indicated in FIG. 3, below the transverse frame member 20 there is affixed between the longitudinal frame members 14 and 15 a gate support member 30, which in the form shown is of quadrilateral transverse cross-sectional configuration and is tubular in nature. Member 30 is spaced below the frame member 20 and extends between frame members 14 and 15 to define a gate opening 32 through which operates a door plate or gate 34 arranged in accordance with the present invention that is mounted on a slideway 36 that in the form shown is defined by trackway members 38 and 40 that are suitably affixed, as by welding, to respective frame members 14 and 15.

The slideway 36 is also defined by an outwardly projecting support member 42 of channel shaped transverse cross-sectional configuration (see FIG. 1) defining web 45 and opposed side flanges 47 which at its end 44 is suitably affixed as by welding, to the gate support member 30. Member 42 is disposed along the centerline of slideway 36 and at its outwardly projecting end 46 is connected by suitable bolt and nut device 48 to the end 50 of brace member 52 which has its other end 54 suitably affixed to transverse frame member 20, as by welding. Spacer 56 separates the member 42 and 52 at their respective ends 46 and 50, as indicated in FIG. 3, in the form shown.

In accordance with the present invention, the door plate or gate 34 is of molded one piece construction and is formed from a suitable high density type polymer having self lubricating characteristics, such as polyethylene. It has been found that for purposes of this invention the so called ultra high molecular weight polymers are best suited for the practice of the invention. One suitable material of this type is polyethylene having a molecular weight of at least 2 million. Other comparable materials may also be employed. The molecular weight should be at least 2 million and no greater than about 10 million as material having a molecular weight much above 10 million becomes too difficult to work. The high molecular weight range specified insures the high strength, wear resisting, self lubricating, low coefficient of dynamic friction characteristics that are desired for this invention while at the same time providing a material that resists flow under significant unit pressures and yet is sufficiently workable in nature to permit formation, by injection molding, of the product shape desired.

The gate 34 is shaped to define planar upwardly facing surface 60, and planar downwardly facing surface 62. Gate 34 is formed to define forward edge or end 64 that is beveled as at 66 (see FIG. 3) for close fitting engagement with the frame member 18, a rear end or edge 68, and side edges 70 and 72, with the rear end 68 and side edges 70 and 72 being substantially normal to the gate surfaces 60 and 62. The gate surface 62 thus rides on trackway members 38 and 40 which may be formed from steel, and a coefficient of sliding or dynamic friction of the gate on members 38 and 40 of 0.02 is provided, as compared with 0.20 for steel on steel. The lightweight material from which the gate is formed provides a gate that may be a hundred pounds or more lighter than gates of comparable length and width of a conventional type formed from steel.

On either side of the gate 34, adjacent its respective side edges 70 and 72, are formed integral racks 74 and 76 (see FIG. 2), each defined by a plurality of integral rack teeth 78. The teeth 78 of the respective racks 74 and 76 respectively cooperate with the respective gears 80 and 82 that are suitably affixed to operating shaft 84 that is journaled in the frame members 14 and 15 below the slideway 36, with the respective gears 80 and 82 being respectively in meshing engagement with the teeth 78 of the respective racks 74 and 76. Support member 42 is suitably notched (not shown) at its flanges 47 to accommodate shaft 84.

The shaft 84 in the form shown is journaled in suitable bearings 86 and 87 (see FIG. 1) suitably mounted in the respective frame members 14 and 15, with the shaft 84 having keyed to its respective ends suitable hub structures 90 and 92 that are adapted for cooperation with conventional pneumatic wrenches or the like to reversibly rotate the shaft 84 so as to move the gate 34 between its closed position of FIG. 3, at which the port 22 is closed by the gate 34, and open position to the right of that shown in FIG. 3, and which the port 22 is fully opened.

Operably associated with the gate 34 is a top seal device 100 of the type described in Chierici U.S. Pat. Nos. 3,635,170 and 3,807,318. The seal device 100 generally comprises an open centered seal stripping 102 secured to the respective frame members 14, 15, 18 and 20 and formed to overlie the margins of the outlet opening 22 to define a flexible edge portion or flap 104 in circumambient relation about the opening 22 that engages the gate top surface 60 about the margin of the gate when the gate is in its closed position. The seal stripping 102 has the general transverse cross-sectional configuration shown in said U.S. Pat. No. 3,807,318 and comprises mounting portion 106 that is formed from a relatively stiff polyurethane material while the flap portion 104 that is integral therewith is formed from a relatively flexible polyurethane material, with the polyurethane materials involved being secured together by affinity along their point of merger in the manner indicated in said U.S. Pat. No. 3,807,318.

The seal stripping 102 in the form shown comprises separate seal strips 108, 110, 112 and 114 proportioned and mitered at intersecting corners for the wiping engagement with the gate upper surface 60 that is indicated in FIGS. 3–5. The individual strips forming stripping 102 are affixed in place by employing suitable rivets 116. Each such strip defines a mounting portion 111 and a lip poriton 113.

It is preferred that the polyurethane material forming the seal stripping mounting portion 106 have a durometer on the order of 90, while the material forming the sealing flap portion 104 have a durometer on the order of 55. As indicated in FIGS. 4 and 5, the seal stripping 102 is preferably scalloped or recessed therealong about the outer side of same adjacent the base of the flap 104, where indicated at 120, so as to define the fulcrum about which the sealing flap 104 operates. The seal stripping sealing lips 113 are thus anchored to the stripping mounting portions 111 by being integral therewith, with the sealing lips projecting centrally of the outlet opening 22 and in substantial parallelism to same, to define the marginal flap 104, the undersurface 124 of which is biased against the upper surface 60 of the gate 34 in effecting the seal contemplated by the invention.

The sealing flap portion 104 of the seal stripping 102 preferably is shaped so that when the gate is moved to the open position, the sealing flap will incline downwardly of the opening 22 so that the stripping sealing flap will have a bias against the gate when the gate is moved to its closed position.

As indicated in FIG. 4, the edge 130 of the stripping 102 along the frame member 18 is beveled as at 132 for guiding cooperation with the gate 34 as the gate moves to its fully closed position, while the edge 134 of the stripping along the frames 14, and 15 and is squared off, as indicated at 134 in FIG. 5. The stripping 114 along the frame member 20, which is located at the right hand side of the outlet opening as shown in FIG. 3, provides a shaping that effects efficient wiping off of the gate 34 as the gate 34 is moved from its closed to its open position. The rear end 68 of the gate engages spacer 56 to stop the gate in its open position, wherein the front edge 64 of the gate will be disposed below and under stripping 114, but preferably still in engagement with its lip portion 113 and resting on member 30 (with the gate 34 and the position of spacer 56 being proportioned and spaced to this end). The members 42 and 52 together with spacer 56 thus define a positive gate stop or retainer 139 for the gate 34 which prevents its dislodgement from slideway 36.

Gate 34 is made to have a thickness of approximately one inch for strengthening purposes. This increased thickness dimension (over steel gates of standard thickness) also spreads out unit loading on the gate side edges 70 and 72 where engagement of these gate edges with the frame members 14 and 15 will be involved, to avoid galling of the gate edges 70 and 72 in service.

Operably associated with the gate 34 is automatic lock device 140 which comprises an operating rod 142 journaled between the legs 144 of a U-shaped mounted bracket 146 that is suitably affixed to the support member 52 so as to dispose the operating rod 142 transversely of the gate slideway 36. Fixed to the operating rod 142 on either side of the gate support member 52 are a pair of locking pawls 150 which are of identical generally triangular configuration defining a base portion 152 and an apex portion 154 (see FIGS. 3, 6 and 7). At one end 156 of the pawl base portion there is formed a notch 158 that is adapted to receive the rear edge or end 68 of the gate in the locking position of the pawls 150, as indicated in FIG. 3.

The apexes 154 of the respective locking pawl bases 152, at the pawl sides 162, serve as a striking surface against which the rear edge 68 of the door plate or gate 34 engages in being moved to its open position, when the locking pawls 150 are disposed in their released positions of FIG. 6, whereby as the gate moves past the locking pawls to the right of FIGS. 6 and 7, the locking pawls are engaged by the gate and are moved to the position of FIG. 7, wherein the ends 160 of the respective locking pawl bases 152 rides on the top surface 60 of the gate 34 as the gate moves between its open and closed positions.

The gate support member 42 has a stop member 164 secured to either side of same, the stops 164 in the form shown each comprise an angle member 166 defining a stop surface 168 for the respective pawls 150.

As indicated in FIG. 3, when the gate is returned to its closed position, the pawls 150 swing under gravity counter-clockwise to bring the ends 160 of the pawl bases 154 into engagement with the respective stop members 164, and specially, their stop surfaces 168.

In accordance with the invention, the masses of the pawls 150 and the operating rod 142 are oriented such that when the pawls 150 are moved from the position of FIG. 3 to the position of FIG. 6, they move clockwise of FIG. 3 to an over center position for retention in the position of FIG. 6 under gravity, but when the gate is moved toward its open position to engage the pawls 150 and move them to the position of FIG. 7, the pawls are gravity biased in a counterclockwise direction to swing down to the position of FIG. 3, when the gate is returned to its closed position so that the end 160 of the pawls can automatically swing under gravity past the rear edge 68 of the door plate. Pawls 150 are therefore proportioned relative to the axis of pivotal movement of rod 142 so that the pawl base ends 160 will clear the rear end or edge 68 of gate 34 in its closed position.

In accordance with the invention, the stop members 164 are positioned, and the shape of the pawl notches 158, have a configuration, such that when the pawls 150 are in their gate stopping positions of FIG. 3, the gate is not normally engaged by the pawls 150. During normal operation the gate is thus spaced from the locking pawls 150. When the car to which the arrangement 10 is applied is being moved empty, the gate 34 may move back and forth and periodically engage the locking pawls 150, which thus serve to limit movement of the gate in its gate opening direction.

In the form shown, the forementioned bias of the locking pawls 150 is obtained by shaping the operating rod 142 and orienting the locking pawls with respect to same, such that a gravity actuated bias is provided. The operating rod 142 is thus shaped to define identically located and configured handles 170 on either side of same to facilitate operation of the operating rod 142 as well as provide the gravity bias indicated.

Operably associated with the locking pawls 150 is a security lock arrangement 172 comprising a wedging pawl 174 for each locking pawl 150 and in coplanar relation therewith, with the wedging pawls 174 defining convexly contoured wedging surfaces 176 positioned to wedgingly cooperate with wedge surface 178 at the apex of the respective pawls 150 (see FIG. 3) to wedge the locking pawls 150 in their gate stopping positions. Wedging pawls 174 are affixed, in the form shown, to either end of a pivot rod 180 that is suitably pivotally mounted on the frame 12. In the form shown, rod 170 is interposed between a pair of abutment plates 182 and 184 suitably affixed to the member 52 in spaced apart relation to define an operating pivot pocket 186 for the rod 180. Rod 180 is held in its general position by retainer plate 188 that is suitably affixed to abutment plate 182, as by welding.

When the locking pawls 150 are in their positions of FIG. 3, the wedging pawls 174 may be brought into wedging relation with the locking pawls in the manner indicated in FIG. 3, as by bringing their convexly contoured wedging surfaces 176 into the respective wedging surfaces 178 of the locking pawls. The wedging pawls 174 may be suitably tapped with a hammer or the like to achieve the desired wedging relation. The wedging pawls each carry a top plate 190 that is apertured as at 192 for application thereto of a suitable car seal between the respective top plates 190 and the respective stop members 164 which also have a corresponding car seal retaining openings 194 formed therein.

Frame members 14, 15 and 18 are flanged as at 196, and angle member 198, defining support flange 200, is suitably affixed to member 30, for application to outlet 22, over door plate 34, of a conventional cover or boot (not shown) held in place by conventional boot clips (not shown). Door plate or gate 34 at its forward edge engages conventional supports 202 in its closed position. Supports 202 each may comprise a lug 204 suitably fixed to frame member 18 (as by welding) and having a rounded corner 206 facing the gate. Door plate 34 may be indented horizontally and in the direction of its forward edge 66, at its rear edge 68, as required to accommodate positioning of the locking pawls 150 closer to the frame 12.

It will therefore be seen that the invention provides an outlet gate arrangement wherein the gate is formed from a self-lubricating light weight non-metallic material that cooperates with a top seal in the form of an overhanging flexible lip or flap that is also formed from non-metallic materials that is biased against the upper surface of the gate, which surface is planar for cooperation with the top seal lip to provide the wiping engagement contemplated by this invention. The low coefficient of sliding friction of the gate on its slideway and its light weight minimizes torque requirements to move the gate between its closed and opened positions.

Thus, the top seal and gate arrangement of this invention not only provides an effective sealing of the lading when the car is loaded, through the gravity biasing action of the lading within the hopper on the top seal, but also, the top seal wipes the top of the gate clean on movement of the gate to its open position. The freedom of the gate from adherence thereto of the bulk materials that may be involved insures a full clearance of the gate top of the bulk materials as the gate is moved to its open position, and thus an uninterrupted seal about the margin of gate 34 (and thus outlet 22).

The positive gate stop arrangement provided together with the particular rack and gear drive mechanism for the gate avoids the need to have extensions of the trackway forming bars 38 and 40 beyond the ends of the frame members 14 and 15 while insuring that the gate has the full guiding action required as well as a positive stop that precludes accidental throwing out of the gate from its slideway when the gate is open using one of the conventional power operating devices currently in use.

The automatic gate lock is simple and effective and also accommodates ready sealing of the car for transit.

The gate is readily moved between its closed and open positions by suitably connecting to the shaft 84 suitable torque applying means, such as a conventional air operated wrench.

The foregoing description and the drawings are given merely to explain and illustrate the invention and the invention is not to be limited thereto, except insofar as the appended claims are so limited, since those skilled in the art who have the disclosure before them will be able to make modifications and variations therein without departing from the scope of the invention.

I claim:

1. In a hopper outlet gate assembly for bulk material carrying railroad hopper cars in which the car hopper has a discharge opening, with the assembly including a frame having four planar sheets in downwardly converging relation and forming a funneling portion terminating in an outlet port of quadrilateral configuration, a gate for closing the port, a slideway for the gate, which slideway extends sidewise and across the outlet port, and means for moving the gate longitudinally of the slideway between a first position in which it is disposed across the port to close same and a second position in which it is disposed to one side of the port and away from overlapping with the port to render the port fully open for discharge of the bulk materials therefrom, the improvement including:

a seal stripping secured to said funneling portion about the port and disposed adjacent to but above the port and the slideway for forming a top seal for the gate, said stripping being of open centered quadrilateral configuration defining rectilinear sides merging into corners at adjacent ends of the stripping sides, which corners respectively complement corners defined by said sheets, said stripping defining thereabout a lip portion disposed about the port defining a flap that projects centrally of the port and that is disposed about the port for sliding engagement with the upper side of the gate when the gate is moved between its said positions, said flap defining an upwardly facing side adapted to be engaged by the lading when in the funneling portion, and a downwardly facing side disposed for face to face sealing engagement with the gate said upper side when the gate is in its said first position, said gate comprising a planar member of molded one piece construction formed from an ultra high molecular weight polymer having self lubricating characteristics and characterized by its surfacing being resistant to adherence thereto of the bulk material, with said gate upper side being substantially planar across the length and width of same and said gate under side being in sliding engagement with said slideway for movement therealong by said gate moving means between said positions thereof, said gate and said stripping flap being disposed in parallel planes extending transversely of said funneling portion, with said stripping flap being formed from resiliently flexible plastic material, said stripping being formed to bias said flap against the gate upper surface for wiping engagement therewith for effecting said sealing engagement with said gate upper side when said gate is disposed in vertical alignment with said flap, said gate having formed in the underside of same rack means extending parallel to said slideway and that are free of engagement with said slideway, gear means journaled in said frame and meshing with said rack means, and means for reversibly rotating said gear means to move said gate between said positions thereof, said rack means, said gear means, and said gear reversibly rotating means comprising said gate moving means, whereby said gate is free from adherence of the bulk materials carried by the car adhering thereto, and said stripping flap wipes the gate said upper side free of the bulk materials free of disturbence of said flap sealing engagement when the gate is moved from said first position to said second position by said gate moving means, and effect the case of moving same from said first position when the car hopper is loaded with bulk material, under the gravity biasing action of the bulk material on said top seal and on said gate upper side within the confines of said stripping.

2. The improvement set forth in claim 1 wherein:

said gate is of quadrilateral outline defining opposed front and rear edges and opposed side edges extending normally of said front and rear edges thereof, said slideway being formed by a pair of spaced apart parallel elongate trackway members on which the respective gate side edges are respectively supported for sliding movement between said positions.

3. The improvement set forth in claim 2 wherein:

said trackway members each defining an upstanding gate guide surface extending longitudinally thereof, with said gate being proportioned to dispose its said side edges in substantial guiding relation to the respective trackway member guide surface, said gate at said side edges having a substantial thickness, and said trackway guide surfaces having a height that is at least equal in dimension to said gate side edge thickness, whereby the area of engagement of said gate side edges with said trackway guide surfaces precludes galling of the gate.

4. The improvement set forth in claim 2 including:

a gate retainer, said gate retainer comprising:

an elongate frame member disposed beneath said gate between said trackway members and extending parallel thereto, said frame member being fixed to said frame with the other end of same projecting away from said frame, and an elongate brace member having one end fixed to said frame member end and the other end of same fixed to said frame to dispose said brace member above and across said slideway in vertical alignment with said frame member, said frame member and said brace member adjacent their juncture serving as a positive stop for said gate limiting movement of said gate away from said first position to said second position.

5. In a hopper outlet gate assembly for railroad hopper cars in which the car hopper has a discharge opening, with the assembly including a frame having four planar sheets in downwardly converging relation and forming a funneling portion terminating in an outlet port, a gate for closing the port, a slideway for the gate, which slideway extends sidewise and across the outlet port, and means for moving the gate longitudinally of the slideway between a first position in which it is disposed across the port to close same and a second position in which it is disposed to one side of the port and away from overlapping with the port to render the port fully open, the improvement including:

a seal stripping secured to said funneling portion about the port and disposed adjacent to but above the port and the slideway, said stripping being of open centered quadrilateral configuration defining rectilinear sides merging into corners at adjacent ends of the stripping sides, which corners respectively complement corners defined by said sheets, said stripping defining thereabout a lip portion disposed about the port defining a flap that projects centrally of the port and that is disposed about the port for sliding engagement with the upper side of the gate when the gate is moved between its said positions, said flap defining an upwardly facing side adapted to be engaged by the lading when in the funneling portion, and a downwardly facing side disposed for face to face sealing engagement with the gate said upper side when the gate is in its said first position, said gate comprising a planar member of molded one piece construction formed from a high density polymer having self lubricating characteristics, with said gate upper side being substantially planar, said gate and said stripping flap being disposed in parallel planes extending transversely of said funneling portion, with said gate upper side being substantially planar, said gate and said stripping flap being disposed in parallel planes extending transversely of said funneling portion, with said stripping flap being formed from resiliently flexible material, said stripping being formed to bias said flap against the gate upper surface for wiping engagement therewith, said gate having formed in the underside of same rack means extending parallel to said slideway, gear means journaled in said frame and meshing with said rack means, and means for reversibly rotating said gear means to move said gate between said positions thereof, said rack means, said gear means, and said gear reversibly rotating means comprising said gate moving means, whereby said gate is free from bulk materials adhering thereto, and said stripping flap wipes the gate said upper side free of the bulk materials when the gate is moved from said first position to said second position by said gate moving means, said gate being of quadrilateral outline defining opposed front and rear edges and opposed side edges extending normally of said front and rear edges thereof, said slideway being formed by a pair of spaced apart parallel elongate trackway members on which the respective gate side edges are respectively supported for sliding movement between said positions, a gate retainer, said gate retainer comprising:

an elongate frame member disposed beneath said gate between said trackway members and extending parallel thereto, said frame member being fixed to said frame with the other end of same projecting away from said frame, and an elongate brace member having one end fixed to said frame member end and the other end of same fixed to said frame to dispose said brace member above and across said slideway in vertical alignment with said frame member, said frame member and said brace member adjacent their juncture serving as a positive stop for said gate limiting movement of said gate away from said first position to said second position, latching means for holding said gate in said first position, said latching means comprising:

a shaft journaled from said brace member and extending crosswise of said trackway members, said shaft being disposed above said slideway, said shaft having fixed thereto a pair of locking pawls in spaced apart relation, said pawls being of identical generally triangular marginal outline configuration defining a base portion and an apex portion, said pawls at said base portions thereof being notched adjacent one end of same, with said pawls being disposed relative to said slideway such that in said first position of said gate said pawls receive the gate rear edge with said pawl bases inclining downwardly of said slideway across the plane of said gate in the direction of the gate second position, to form the gate locking position of said pawls, a stop element fixed to said frame and positioned to be engaged by said pawls adjacent the other ends of their said base portions, to form the gate locking position of said pawls, said pawls being disposed on said shaft such that when said shaft is positioned to dispose the apexes of said pawls downwardly, said pawl notches are upwardly disposed above the plane of said gate and said pawl apexes are disposed within said gate plane for engagement by the gate rear edge in moving from said first to said second position thereof, to form the open position of said pawls, said shaft and pawls having their masses oriented such that when said pawls are in said open position they are retained there by gravity and when said gate is moved from said first to said second position thereof into riding engagement with the gate upper surface with said pawls being gravity biased against the gate upper surface, whereby when said gate is moved from said second to said first position thereof, said pawls drop behind the gate rear edge to said gate locking position thereof, said notches of said pawls being formed such that in said locking positions thereof they are free of engagement with said gate when said gate is in said first position thereof.

6. The improvement set forth in claim 5 including:

means for latching said locking pawls in their said locking positions including:

a jamb pawl for each of said locking pawls and each including a jamb face, said lock pawls each being formed adjacent their apexes with jamb surfaces adapted to be engaged by the respective jamb pawl jamb surfaces, said jamb pawls being mounted for movement to bring their respective jamb faces into jambing relation with the respective locking pawl jamb surfaces when said pawls are in their gate locking positions whereby said locking pawls are biased against said stop element to the exclusion of said gate, and means for releasably holding said jamb pawls in said jambing relation with said locking pawls.

* * * * *

UNITED STATES PATENT OFFICE

CERTIFICATE OF CORRECTION

Patent No. 4,006,692 Dated February 8, 1977

Inventor(s) OSVALDO F. CHIERICI

It is certified that error appears in the above-identified patent and that said Letters Patent are hereby corrected as shown below:

Claim 1, Column 8, line 46, "case" should read --ease--.

Signed and Sealed this

*Sixth* Day of *February 1979*

[SEAL]

*Attest:*

RUTH C. MASON
*Attesting Officer*

DONALD W. BANNER
*Commissioner of Patents and Trademarks*